US008232496B2

(12) United States Patent
Granhaug et al.

(10) Patent No.: US 8,232,496 B2
(45) Date of Patent: Jul. 31, 2012

(54) SWITCH DISCONNECTOR

(75) Inventors: Ole Granhaug, Skien (NO); Jan-Henrik Kuhlefelt, Skien (NO); Pal Skryten, Skien (NO)

(73) Assignee: ABB Technology AG, Zurich (CH)

( * ) Notice: Subject to any disclaimer, the term of this patent is extended or adjusted under 35 U.S.C. 154(b) by 720 days.

(21) Appl. No.: 11/919,177

(22) PCT Filed: Apr. 18, 2006

(86) PCT No.: PCT/EP2006/003500

§ 371 (c)(1),
(2), (4) Date: Mar. 12, 2009

(87) PCT Pub. No.: WO2006/114214

PCT Pub. Date: Nov. 2, 2006

(65) Prior Publication Data

US 2009/0314745 A1 Dec. 24, 2009

(30) Foreign Application Priority Data

Apr. 25, 2005 (DE) ..... 10 2005 019 424

(51) Int. Cl.
*H01H 33/12* (2006.01)

(52) U.S. Cl. ..... 218/18; 218/46; 218/76

(58) Field of Classification Search ..... 218/18, 218/46, 76

See application file for complete search history.

(56) References Cited

U.S. PATENT DOCUMENTS 3,995,130 A * 11/1976 Mauthe et al. ..... 218/85
4,082,405 A * 4/1978 Stepniak ..... 439/184
4,138,180 A * 2/1979 Bernier ..... 439/682
4,299,431 A * 11/1981 Wilson et al. ..... 439/281
4,628,164 A * 12/1986 Talpo ..... 218/65
4,935,590 A * 6/1990 Malkin et al. ..... 218/57
5,059,130 A * 10/1991 Miller, Jr. ..... 439/74

(Continued)

FOREIGN PATENT DOCUMENTS

DE 1 590 210 5/1970

(Continued)

OTHER PUBLICATIONS

International Search Report for PCT/EP2006/003500 dated Aug. 3, 2006.

(Continued)

*Primary Examiner* — Truc Nguyen
(74) *Attorney, Agent, or Firm* — Buchanan Ingersoll & Rooney PC

(57) ABSTRACT

A switch disconnector is disclosed. The switch disconnector has a main contact point and an arc interruption contact point, of which the main contact point opens before the arc interruption contact point during a disconnection operation and is closed after the arc interruption contact point during connection, with a stationary and a moving contact-piece arrangement, with the stationary contact-piece arrangement having a pot contact piece with contact fingers and with the moving main contact point having a contact cylinder which is connected to a contact mount, and with the arc interruption point having a contact pin as the stationary contact piece and an annular contact piece as the moving contact piece. The contact pin has a section composed of interruption-resistant material, whose external diameter is greater than the external diameter of the rest of the pin area. The contact pin has at least one slot which runs in the longitudinal direction and splits the pin into at least two pin fingers.

12 Claims, 2 Drawing Sheets

U.S. PATENT DOCUMENTS

Figure 2:
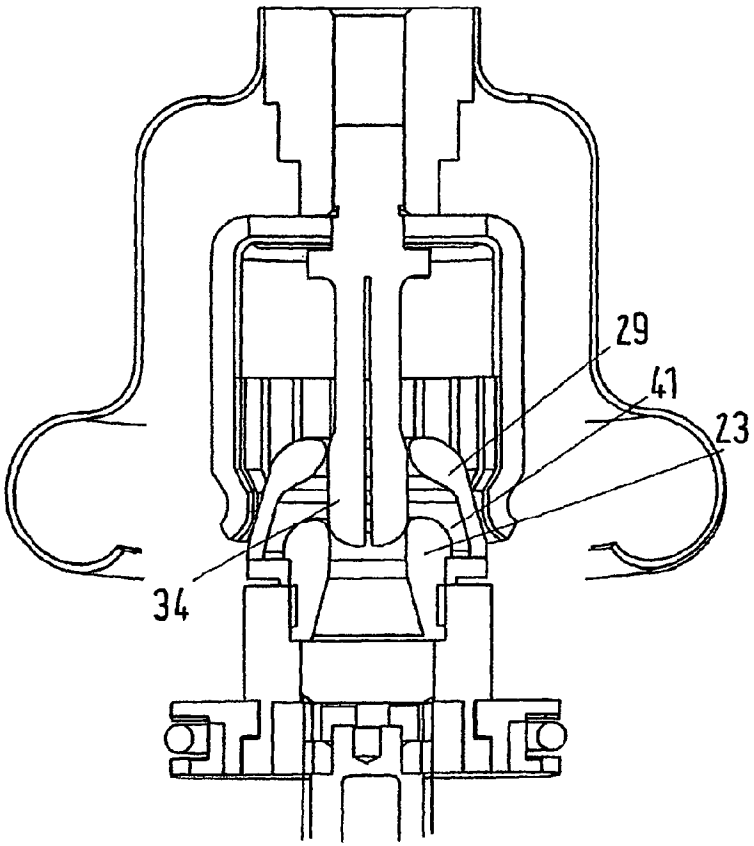

| | | | | |
|---|---|---|---|---|
| 5,199,879 | A * | 4/1993 | Kohn et al. | 439/63 |
| 6,860,769 | B2 * | 3/2005 | Liu et al. | 439/887 |

FOREIGN PATENT DOCUMENTS

| | | | |
|---|---|---|---|
| DE | 10 2005 009 207 | A1 | 8/2006 |
| EP | 0 700 062 | A1 | 3/1996 |
| EP | 0 951 029 | A2 | 10/1999 |
| NR | 1 838 276 | | 9/1961 |

OTHER PUBLICATIONS

German Search Report dated Mar. 16, 2006.

* cited by examiner

SWITCH DISCONNECTOR

The invention relates to a medium-voltage switch disconnector as claimed in the precharacterizing clause of claim 1.

German Patent Application DE 10 2005 009 207.1 describes a switch disconnector of the type mentioned initially, which is installed in a medium-voltage switchgear assembly and has the task there of disconnection and connection at the rated load. For this purpose, the switch disconnector has a stationary contact-piece arrangement and a moving contact-piece arrangement, which is attached to a contact spindle or a contact rod as a contact mount, which is coupled to a pivoting lever arrangement that is operated by a driveshaft.

The contact point comprises a main contact point and an arc interruption point, with the main contact point having a pot contact piece with contact fingers.

The object of the invention is to optimize a switch disconnector of the type mentioned initially.

According to the invention, this object is achieved by the features of claim 1.

Further advantageous refinements and improvements of the invention can be found in the other dependent claims.

Figure 1:
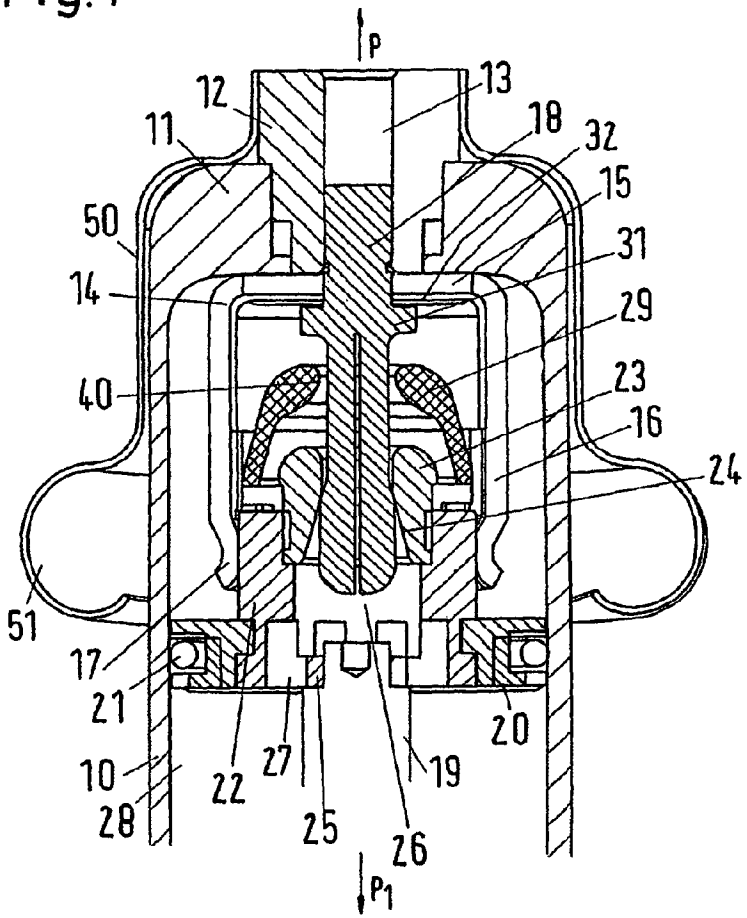
Figure 3:
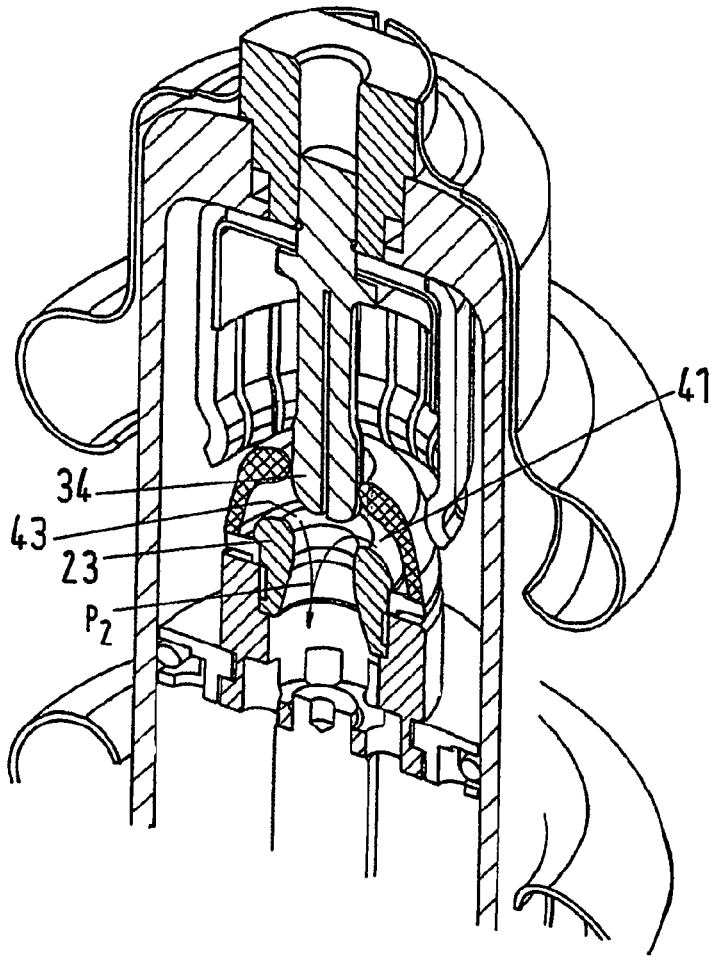
Figure 4:
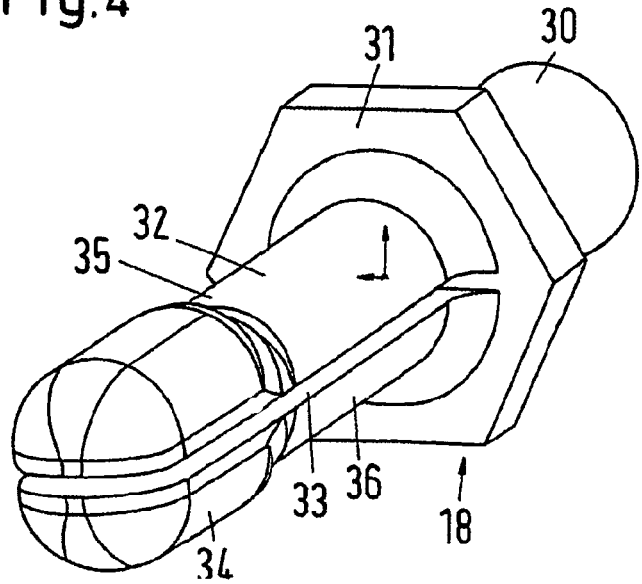

The invention as well as further advantageous refinements and improvements of the invention will be explained and described in more detail with reference to the drawing, which illustrates one exemplary embodiment of the invention, and in which:

FIG. 1 shows a contact point of a switch disconnector in the connected position, FIG. 2 shows the contact point from FIG. 1, shortly before the disconnected position, FIG. 3 shows a perspective view of the main contact points during further disconnection, and FIG. 4 shows a perspective view of a contact pin.

Reference is made to FIG. 1.

The contact point of a switch disconnector as shown there is located in an enclosure 10 in the form of a pot and composed of insulating plastic, as has been disclosed in DE 10 2005 009 207.1. At its free end, the container 10 is closed by a base section 11 in which a cylindrical contact section or sleeve 12 is fixed, which has a hole 13 via which a connecting line can be connected as indicated by the direction of the arrow P. A stationary main contact piece 14 is connected to the inner end of the contact sleeve 12 and is in the form of a tulip with a baseplate 15 and contact fingers 16 connected to it, which have a drawn-in area 17, pointing inwards, at their free ends. A contact pin 18, which is illustrated in more detail in FIG. 4, is fixed in the hole 13.

A contact mount 19 in the form of a contact rod is guided (in a manner which is not illustrated in any more detail) within the container 10, and a sealing plate is attached to its inner end, and is fitted on its outer circumference with a seal 21 which rests against the inner surface of the container 10, where it is used to form a seal. A cylinder 22 is attached to the plate 20 and is fitted on its inner surface with a contact piece 23 in the form of a nozzle, with the nozzle shape forming the inner contour 24. At its opposite end to the contact piece 23, the cylinder 22 has a strip 25 which projects radially inwards, surrounds the contact rod 19 and is firmly connected to it there. The interior 26 of the cylinder 22 is provided in the area of the strip 25 with aperture openings 27 which, in the axial direction, connect the interior 26 to the area 28 underneath the plate 20. A blowing cylinder 29 composed of insulating plastic is attached to the end of the cylinder 22 on the side opposite the plate 20.

Reference is now made to FIG. 4.

FIG. 4 shows the contact pin 18. This contact pin 18 has an approximately cylindrical shape and has a pin section 30 which is inserted with a force fit into the hole 13. The section 30 is connected to a hexagonal plate section 31 which rests against the inner surface 32 of the base 15 of the main contact piece 14 and firmly connects the main contact piece 14 to the contact cylinder 12. The contact pin 18 has a contact finger section 33 which has a widened section 34 radially at its free end, which gives the contact pin 32 a microphone-like structure. The contact pin 32 has an axially running longitudinal slot 33, thus forming two contact pin fingers 35 and 36. The external diameter of the section 34 is greater than the internal diameter of the contact piece 23, so that, when a disconnection operation occurs, that is to say when the contact piece mount is drawn in the direction of the arrow $P_1$, the inner surface of the contact piece 23 slides onto the outer surface of the section 34, thus forcing the two contact pin fingers 35 and 36 towards one another.

The contact piece 23 is composed of material which is resistant to arc interruption, as is the section 34.

When a switching operation now occurs and the contact mount 19 is drawn downwards with the moving contact piece 23 (see FIG. 1) in the direction of the arrow $P_1$, then the contact cylinder 22 slides out of the contact fingers 16, as can be seen in FIG. 2; however, in this case, the contact pin 18 is still electrically conductively connected to the contact piece 23 so that, once the contact finger 16 has been disconnected from the contact cylinder 22, the current flows from the contact cylinder 22 via the contact piece 23 towards the contact pin 18.

The blowing cylinder 29 has an opening 40 whose internal diameter corresponds approximately to the external diameter of the section 34. In the position shown in FIG. 2, the opening of the blowing cylinder 29 slides onto the section 34. As soon as the contact piece 23 has been disconnected from the section 34 of the contact pin 32, an arc 43 is formed there (see FIG. 3) and is blown from the blowing cylinder 29, which is composed of insulating material, with the gas from it in the area 41. The insulating plastic of the blowing cylinder 29 is composed of material which emits gas, thus resulting in optimum blowing of the arc between the section 34 and the contact piece 23.

FIG. 3 shows the contact arrangement shortly after disconnection of the contact piece 23 from the section 34, with the arc 43 being struck here, which is quenched by quenching gas flowing out of the area 41 in the direction of the arrow $P_2$.

A cup 50 is electrically conductively firmly connected to the contact cylinder 12, surrounds the container 10 and, in the area of the contact point, has a field control ring 51 which is located between the contact piece and the contact cylinder 22, as described in more detail in Patent Application DE 10 2005 009 207.1.

The invention claimed is:

1. A switch disconnector comprising:

a main contact point and an arc interruption contact point, of which the main contact point opens before the arc interruption contact point during a disconnection operation and is closed after the arc interruption contact point during connection;

a stationary and a moving contact-piece arrangement, with the stationary contact-piece arrangement having a pot contact piece with contact fingers and with the moving main contact point having a blowing cylinder, a contact cylinder which is connected to a contact mount, and with the arc interruption point having a contact pin as the stationary contact piece and an annular contact piece formed as a nozzle as the moving contact piece, wherein the contact pin has a section composed of interruption-resistant material, whose external diameter is greater than the external diameter of the rest of the pin area, and wherein the contact pin has at least one slot which runs in the longitudinal direction and splits the pin into at least two pin fingers, and wherein the nozzle is connected to an inner surface of the contact cylinder and has an inner contour for engaging the contact pin of the stationary contact, the contact cylinder is connected to the contact mount via a plate, the blowing cylinder is connected to an end of the contact cylinder opposite the plate, and an interior area of the moving contact-piece arrangement is located between the plate and nozzle and configured to flow gas away from the nozzle to an area below the plate.

2. The switch disconnector as claimed in claim 1, wherein the moving contact piece, which is associated with the arc interruption contact point, is at least partially composed of a material which is resistant to arc interruption.

3. The switch disconnector as claimed in claim 2, wherein a narrowest internal diameter of the nozzle is less than the external diameter of the section on the contact pin, such that the two contact pin fingers of the contact pin are pressed against one another during a switching operation.

4. The switch disconnector as claimed in claim 2, wherein the blowing cylinder is composed of electrically insulating material and surrounds an inner opening whose internal diameter corresponds to the external diameter of the section of the contact pin, such that, once the inner opening has run onto the section, the gas which is located within the blowing cylinder blows the arc which has been struck between the moving contact piece and the contact pin.

5. The switch disconnector as claimed in claim 1, wherein the blowing cylinder is composed of a material which emits gas when an arc occurs.

6. The switch disconnector as claimed in claim 3 wherein the blowing cylinder is composed of electrically insulating material and surrounds an inner opening whose internal diameter corresponds to the external diameter of the section of the contact pin, such that, once the inner opening has run onto the section, the gas which is located within the blowing cylinder blows the arc which has been struck between the moving contact piece and the contact pin.

7. The switch disconnector as claimed in claim 2, wherein the blowing cylinder is composed of a material which emits gas when an arc occurs.

8. The switch disconnector as claimed in claim 3, wherein the blowing cylinder is composed of a material which emits gas when an arc occurs.

9. The switch disconnector as claimed in claim 4, wherein the blowing cylinder is composed of a material which emits gas when an arc occurs.

10. The switch disconnector as claimed in claim 3, wherein the inner contour of the nozzle engages the contact fingers of the contact pin, such that the contact fingers are pressed against one another during a switching operation.

11. The switch disconnector as claimed in claim 1, wherein the nozzle of the moving contact engages the contact pin at the section composed of interruption resistant material.

12. The switch disconnector as claimed in claim 1, wherein the plate includes apertures that connect the interior area of the moving contact to the area below the plate.

* * * * *